US012054808B2

(12) United States Patent
Matzdorf et al.

(10) Patent No.: US 12,054,808 B2
(45) Date of Patent: Aug. 6, 2024

(54) EMBRITTLED ALUMINUM ALLOYS FOR POWDER MANUFACTURING

(71) Applicant: United States of America as represented by the Secretary of the Navy, Patuxent River, MD (US)

(72) Inventors: Craig Matzdorf, Hollywood, MD (US); Michael Brindza, Leonardtown, MD (US)

( * ) Notice: Subject to any disclaimer, the term of this patent is extended or adjusted under 35 U.S.C. 154(b) by 0 days.

(21) Appl. No.: 18/219,902

(22) Filed: Jul. 10, 2023

(65) Prior Publication Data

US 2023/0357891 A1 Nov. 9, 2023

Related U.S. Application Data

(62) Division of application No. 17/737,347, filed on May 5, 2022, now Pat. No. 11,739,395.

(51) Int. Cl.

| | |
|---|---|
| ***C22C 21/02*** | (2006.01) |
| ***B22F 9/04*** | (2006.01) |
| ***C22C 1/02*** | (2006.01) |
| ***C22C 1/04*** | (2023.01) |

(52) U.S. Cl.

CPC ..... *C22C 1/026* (2013.01); *B22F 9/04* (2013.01); *C22C 1/0416* (2013.01); *C22C 21/02* (2013.01); *B22F 2301/052* (2013.01)

(58) Field of Classification Search

CPC ..... C22C 21/02

See application file for complete search history.

(56) References Cited

U.S. PATENT DOCUMENTS

| | | | | |
|---|---|---|---|---|
| 4,804,423 | A * | 2/1989 | Dubost | C22C 21/00 148/438 |
| 2003/0099856 | A1* | 5/2003 | Takeno | B23K 35/002 428/654 |
| 2007/0256763 | A1* | 11/2007 | Ang | C22C 21/02 148/552 |
| 2016/0228950 | A1* | 8/2016 | Bodily | B22F 10/18 |

OTHER PUBLICATIONS

Jack W. Bray, Aluminum Mill and Engineered Wrought Products, ASM Handbook, vol. 2: Properties and Selection: Nonferrous Alloys and Special-Purpose Materials, p. 29-61, 1990.*

Cai et al., Preparation of Al—Si alloys by a rapid solidification and powder metallurgy route, Materials and Design 87 (2015) 996-1002.*

* cited by examiner

*Primary Examiner* — Christopher S Kessler

(74) *Attorney, Agent, or Firm* — Mark O. Glut

(57) ABSTRACT

A powdered alloy with a chemical composition of $Al_xSi$, where X is an amount of Si from 10 to 30 weight percent. More specifically, a powdered alloy with a chemical composition of $Al_xSi_ySn_zIn$, where X is an amount of Si from 10 to 30 weight percent, Y is an amount of Sn from 0.01 to 0.50 weight percent, and Z is an amount of In from 0.005 to 0.05 weight percent.

1 Claim, 3 Drawing Sheets

EMBRITTLED ALUMINUM ALLOYS FOR POWDER MANUFACTURING

CROSS REFERENCES TO RELATED APPLICATIONS

The present invention is a divisional of application Ser. No. 17/737,347 filed May 5, 2022, entitled "Embrittled Aluminum Anode Alloys for Powder Manufacturing,". Application Ser. No. 17/737,347 is incorporated herein by reference.

STATEMENT OF GOVERNMENT INTEREST

The invention described herein may be manufactured and used by or for the Government of the United States of America for governmental purposes without payment of any royalties thereon or therefor.

BACKGROUND

Aluminum and aluminum alloys in the form of particles, powder, and flakes are used in a variety of applications. These applications include, but without limitation, fillers and active corrosion-inhibiting pigments in coatings, sealants and other protective materials, heat reflective and controlling materials such as roofing shingles, asphaltic coatings and sealants, cosmetics, and electrically and thermally conductive fillers for plastics and coatings. These applications use a wide variety of particle sizes and distributions of particle sizes to achieve desired performance.

To achieve controlled particle sizes and distributions, aluminum and aluminum alloy pigments are typically manufactured by a multi-step process: 1) melting of the aluminum or aluminum alloy and atomizing it using inert gas or controlled humidity air; 2) separating the aluminum or aluminum alloy powder into desired particle sizes and distributions; and, optionally, 3) milling the aluminum or aluminum alloy powder into non-spherical flake or flake-like shapes to take advantage of special properties from the flake-like particle geometry, such as increased surface-to-volume ratio, reflectivity, and dispersion properties. This process is highly mature and provides the basis for today's aluminum and aluminum pigment industry and market.

To make aluminum powder the process of atomization is typically used. Atomizing is used for making aluminum or aluminum alloy powder due to its ability to be done at large scale at a reasonably low cost. The only other practical methods to create aluminum alloy powders are electron-beam evaporation or sputtering, which are significantly more expensive and not amenable to large scales. Evaporation of aluminum alloys, which is used to manufacture zinc powders, is not effective due to the different melting points and vapor pressures of the constituent elements.

Atomizing has several disadvantages. There is always an explosion hazard potential during manufacturing and initial powder handling due to the small sizes of particles created during the process (below 10 microns in diameter). In addition, although particle size ranges can be manipulated by varying atomizing parameters, there is always a distribution which is not as well controlled as desired and the powder has to be "classified" or sieved to separate it into the required target average diameters and ranges. This combination of atomizing and classifying steps creates a minimum atomized powder cost which is approximately 5-10 times more expensive than traditional large scale powder manufacturing using mechanical processing.

Historically, it has not been possible to manufacture aluminum and aluminum alloy powders using mechanical processing methods due to aluminum's high ductility and tendency to gall (galling may be defined as, but without limitation, as a form of wear caused by adhesion between sliding surfaces), which causes the metal to smear and stick to itself and the processing equipment. Thus, there is a need for a method and alloy that is low cost and provides exceptional control of particle size and particle size distribution.

SUMMARY

The present invention is directed to with the needs enumerated above and below.

The present invention is directed to a method of creating aluminum alloy powder, the method comprising: blending and melting aluminum and one or more embrittling elements; mixing together the melted aluminum and embrittlers such that an alloy is created; cooling the mixed alloy; cutting the cooled alloy into smaller pieces; crushing the cut pieces; and, pulverizing and milling the crushed pieces into particles with a size of less than 200 micrometers.

The present invention is directed to a method of creating aluminum alloy powder, the method comprising: blending and melting aluminum, one or more embrittling elements (embrittlers) selected from silicon and germanium, and optionally, one or more activation elements selected from gallium, indium, bismuth, and tin; mixing together the melted aluminum, embrittlers, and activators such that an alloy is created; cooling the mixed alloy; cutting the cooled alloy into smaller pieces; crushing the cut pieces; and, pulverizing and milling the crushed pieces into particles with a size of less than 200 micrometers.

The present invention is directed to a powdered alloy with a chemical composition of aluminum with 10-30% by weight silicon, with the silicon being of a sufficient quantity in the alloy to enable mechanical processing.

The present invention is directed to a powdered alloy with a chemical composition of aluminum with 10-30% by weight silicon, 0.01-0.50% by weight tin, and 0.005-0.05% by weight indium. The percentages of the tin and indium may be adjusted to account for the impurities in the aluminum, like iron, which will form intermetallic compounds with the tin and indium and suppress their activity. They may also be adjusted to account for the effect of silicon on electrochemical performance, which varies based on the weight % of silicon in the alloy.

It is a feature of the present invention to provide an aluminum alloy and method that is a low-cost powder with very low ductility (less than 1%).

It is a feature of the present invention to provide an aluminum alloy and method that is zinc free and non-toxic.

It is a feature of the present invention to provide an aluminum alloy and method which enable control of narrow particle size distributions, d10 and d90 less than 50% smaller or greater than the d50, respectively (i.e. d10=5 microns, d50=10 microns and d90=15 microns), as well as powder sizes as small as 4 microns in diameter and flakes 1 micron thick and 10-20 microns long.

It is a feature of the present invention to provide an aluminum alloy and method which include weight-reducing elements such as magnesium and lithium.

DRAWINGS

These and other features, aspects and advantages of the present invention will become better understood with reference to the following description and appended claims, and accompanying drawings wherein:

DESCRIPTION

The preferred embodiments of the present invention are illustrated by way of example below and in FIGS. 1-5. A method of creating aluminum alloy powder is presented herein, the method comprising: blending and melting aluminum, silicon, tin, and indium; mixing together the melted aluminum, silicon, tin, and indium such that the following alloy is created $Al_{20}Si_{0.05}Sn_{0.02}In$; cooling the mixed alloy; cutting the cooled alloy into smaller pieces; crushing the cut pieces; and, pulverizing and milling the crushed pieces into particles with a size of less than 200 micrometers. The alloy is a powdered alloy with a chemical composition of $Al_{20}Si_{0.05}Sn_{0.02}In$. The preferred embodiment utilizes aluminum that is 99.99% pure so that cathodic impurities like copper (Cu) do not impede the activity of the Sn and In.

The method comprises of: blending and melting aluminum of a purity from 99% to 99.999% with an embrittling element or combination of embrittling elements selected from the group consisting of silicon and germanium in the amount of 1 to 30% by weight; mixing together the melted aluminum and embrittling elements such that an alloy is created; cooling the mixed alloy; cutting the cooled alloy into smaller pieces; crushing the cut pieces; and, pulverizing and milling the crushed pieces into particles with a size of less than 200 micrometers.

In one of the embodiments, 0.01% to 20% of a density reducing element selected from magnesium and lithium, or a combination thereof, may be added during the blending portion of the method. Additionally, the powdered alloy may be a chemical composition of Al-20% Si.

In another embodiment, the method comprises: blending and melting aluminum of a purity from 99% to 99.999% with an embrittling element or combination of embrittling elements selected from the group consisting of silicon and germanium in the amount of 1 to 30% by weight and an activating element or combination of activating elements selected from the group consisting of indium, gallium, tin, and bismuth in the amount of 0.01% to 0.50% by weight; mixing together the melted aluminum and embrittling elements such that an alloy is created; cooling the mixed alloy; cutting the cooled alloy into smaller pieces; crushing the cut pieces; and, pulverizing and milling the crushed pieces into particles with a size of less than 200 micrometers. Optionally, 0.01% to 20% of a density reducing element selected from magnesium and lithium or a combination thereof may be added during the blending portion of the method.

The subject invention is a new aluminum alloy which is both brittle (elongation <1%) and electroactive (electrical potential <0.900 volts versus saturated calomel electrode (SCE), efficiency >70%, and high current density). In one of the embodiments, the alloy is aluminum-20% silicon-0.05% tin-0.02% indium or $Al_{20}Si_{0.05}Sn_{0.02}In$.

Figure 1:
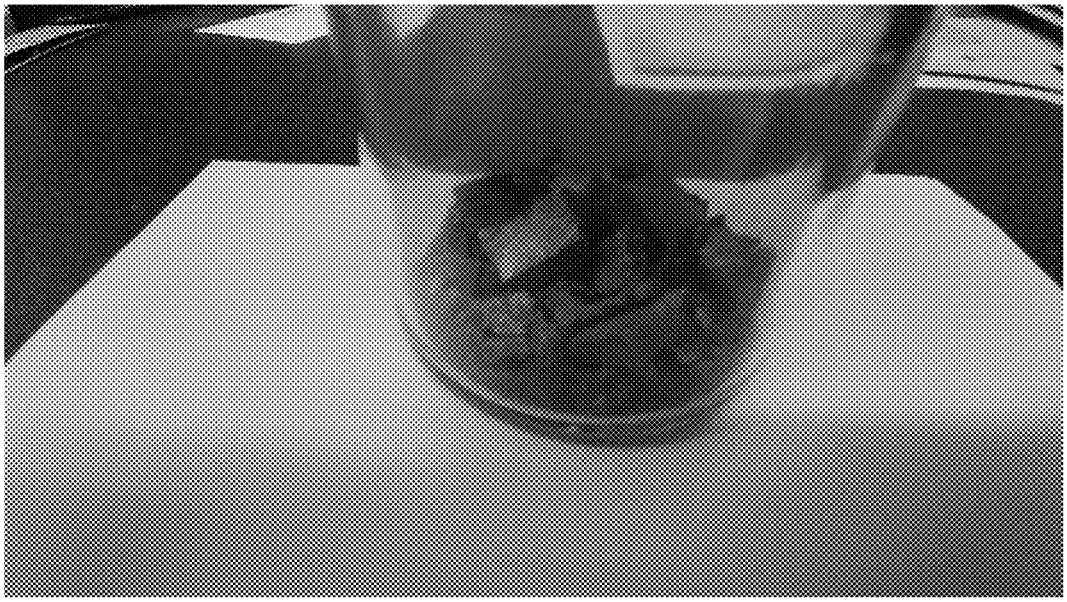
FIG. 1 shows the $Al_{20}Si_{0.05}Sn_{0.02}In$ alloy after being crushed into smaller chunks.
Figure 2:
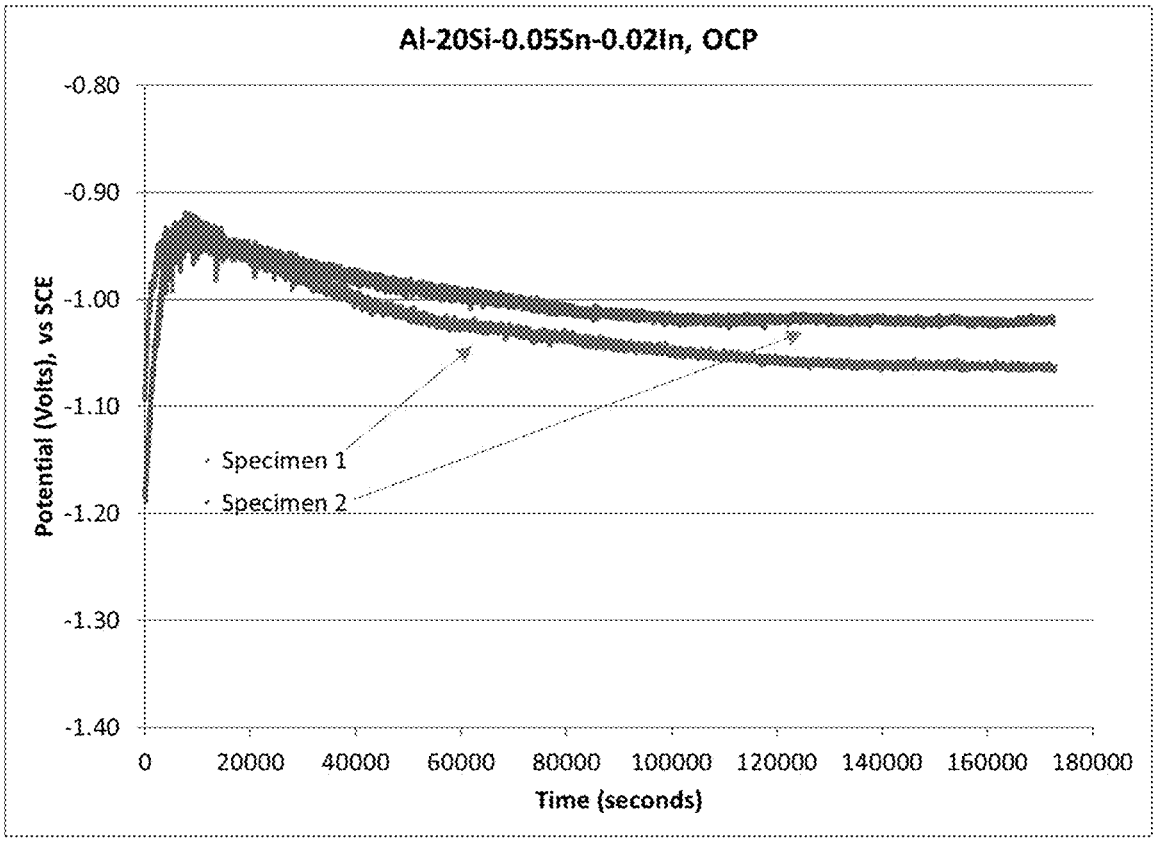
FIG. 2 is a plot of the alloy's open circuit potential (OCP) in 3.5% sodium chloride.
Figure 3:
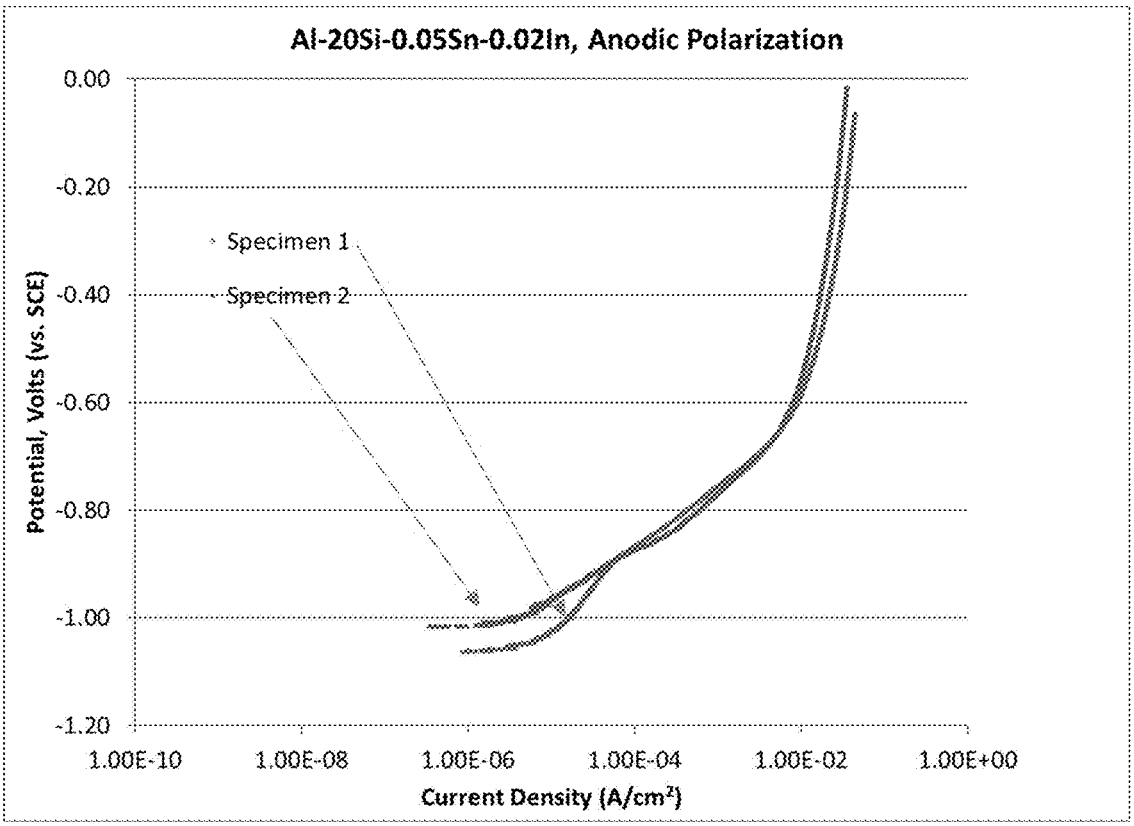
FIG. 3 shows direct current potentiodynamic scans of cast $Al_{20}Si_{0.05}Sn_{0.02}In$.

In a preferred embodiment, this alloy can be made by melting the individual elements together in a crucible or large vessel, mixing thoroughly, and cooling in a mold. Once cooled to room temperature, the bulk aluminum can be cut into small pieces (~1 cubic centimeter), crushed or ground to approximately 1 cubic millimeter, and finally pulverized, and then milled to the final desired particle size of less than 200 micrometers. FIG. 1 shows the $Al_{20}Si_{0.05}Sn_{0.02}In$ alloy after being crushed into smaller chunks. FIGS. 2 and 3 show electrochemical data for the $Al_{20}Si_{0.05}Sn_{0.02}In$ alloy. FIG. 2 is a plot of the alloy's open circuit potential (OCP) in 3.5% sodium chloride. After 24 hours the OCP is about −1.05 volts versus SCE, very similar to the ductile alloy used today for aluminum-rich primers (Al-5.0Zn-0.02In). The OCP is increased by about 150 millivolts compared to an alloy of Al-0.05Sn-0.02In, which is being investigated as a zinc-free alternative to the AlZnIn alloy. This increase is due to the higher electrochemical potential of the silicon (Si) added to the alloy to make it brittle. FIG. 3 is a plot of a direct current potentiodynamic scans (DCPS) of the $Al_{20}Si_{0.05}Sn_{0.02}In$ alloy. In this test, the voltage is scanned from the OCP to about 0 volts versus SCE to determine how much current the alloy supplies. The data show that the alloy provides sufficient current at anticipated operating potentials to be useful.

Figure 4:
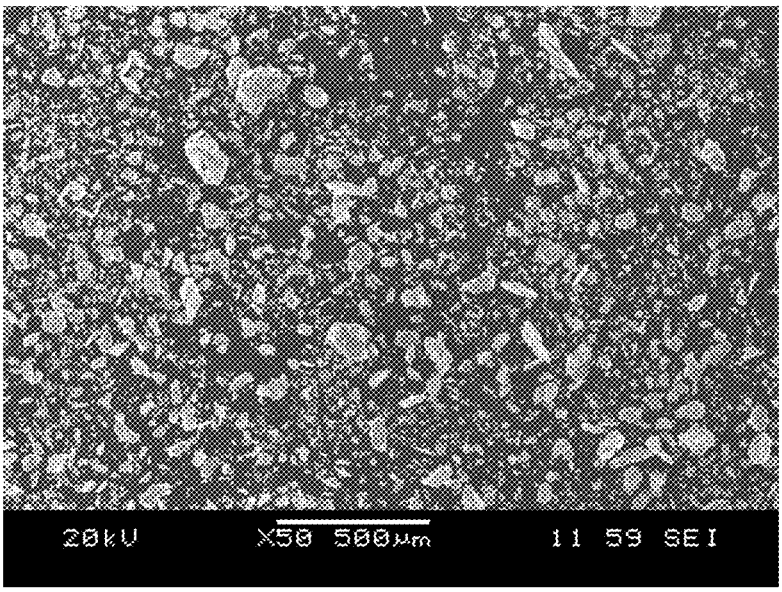
FIG. 4 shows a scanning electron microscope image of ground $Al_{20}Si_{0.05}Sn_{0.02}In$; and, FIG. 5 shows a close up scanning electron microscope image of ground ball milled $Al_{20}Si_{0.05}Sn_{0.02}In$.
Figure 5:
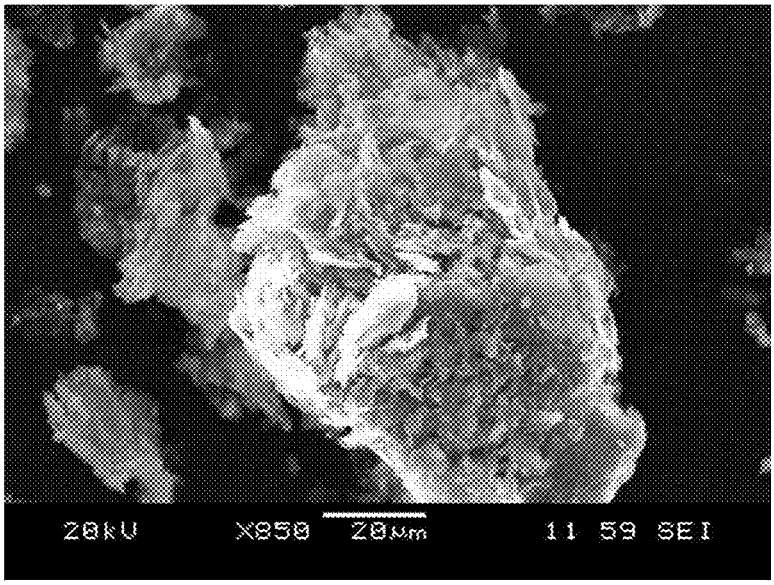

FIGS. 4 and 5 show scanning electron microscope images of cast $Al_{20}Si_{0.05}Sn_{0.02}In$, which has been further mechanically ground into small particles. The images show a very wide range of particle sizes from >100 microns to <1 micron with many falling into the desired range of 5-10 microns. With further optimization, the alloy or milling process can be made into a narrow particle size range with very high yield.

The brittle alloy made be made using a varying amount of Si as the embrittling element or other known embrittling elements such as Ge, Ga (which can also be used as an activator), or combinations of them. For the alloys of interest to Al-rich primers, an optimum alloy is expected which balances the amount of Si with ductility and effect on electrochemical potential. Other elements may be added such as, but without limitation, magnesium (Mg) to adjust electrochemical potential and alloy density.

When introducing elements of the present invention or the preferred embodiment(s) thereof, the articles "a," "an," "the," and "said" are intended to mean there are one or more of the elements. The terms "comprising," "including," and "having" are intended to be inclusive and mean that there may be additional elements other than the listed elements.

Although the present invention has been described in considerable detail with reference to certain preferred embodiments thereof, other embodiments are possible. Therefore, the spirit and scope of the appended claims should not be limited to the description of the preferred embodiment(s) contained herein.

What is claimed is:

1. A powdered alloy with a chemical composition of Al XSi YSn ZIn, where X is an amount of Si from 10 to 30 weight percent, Y is an amount of Sn from 0.01 to 0.50 weight percent, and Z is an amount of In from 0.005 to 0.05 weight percent.

* * * * *